US011338213B2

(12) United States Patent
Heimes

(10) Patent No.: US 11,338,213 B2
(45) Date of Patent: May 24, 2022

(54) ACCELERATION SECTION FOR A WATER SLIDE

(71) Applicant: Frank Heimes, Munich (DE)

(72) Inventor: Frank Heimes, Munich (DE)

( * ) Notice: Subject to any disclaimer, the term of this patent is extended or adjusted under 35 U.S.C. 154(b) by 0 days.

(21) Appl. No.: 17/291,026

(22) PCT Filed: Nov. 12, 2018

(86) PCT No.: PCT/EP2018/080955
§ 371 (c)(1),
(2) Date: May 4, 2021

(87) PCT Pub. No.: WO2020/098905
PCT Pub. Date: May 22, 2020

(65) Prior Publication Data

US 2021/0387102 A1 Dec. 16, 2021

(51) Int. Cl.
*A63G 21/18* (2006.01)

(52) U.S. Cl.
CPC ..... *A63G 21/18* (2013.01)

(58) Field of Classification Search
CPC ..... A63G 21/00; A63G 21/02; A63G 21/14; A63G 21/18; A63G 31/007
USPC ..... 472/116–117, 128, 129; 104/69, 70
See application file for complete search history.

(56) References Cited

U.S. PATENT DOCUMENTS

| | | | | |
|---|---|---|---|---|
| 1,520,217 | A | 12/1924 | Auperl | |
| 6,758,231 | B1 | 7/2004 | Lochtefeld et al. | |
| 7,597,630 | B2 | 10/2009 | Henry | |
| 2006/0111195 | A1 | 5/2006 | Henry | |
| 2014/0194216 | A1* | 7/2014 | Brassard | A63G 21/18 472/88 |
| 2016/0166942 | A1* | 6/2016 | Fisher | B63B 34/52 441/35 |

FOREIGN PATENT DOCUMENTS

KR 20140097777 A 8/2014

OTHER PUBLICATIONS

International Search Report and Written Opinion for International Application No. PCT/EP2018/080955 dated May 22, 2020.

* cited by examiner

*Primary Examiner* — Kien T Nguyen
(74) *Attorney, Agent, or Firm* — Thomas | Horstemeyer, LLP

(57) ABSTRACT

An acceleration section for a water slide, comprising: —a sliding trail in which a person can slide, —a pusher inside the sliding trail, the pusher being configured to accelerate the person inside the sliding trail, —an accelerator track outside of the sliding trail, —an accelerator car miming on the accelerator track and configured to be accelerated along the accelerator track, and —a coupling unit mechanically coupling the pusher and the accelerator car.

20 Claims, 12 Drawing Sheets

ACCELERATION SECTION FOR A WATER SLIDE

CROSS-REFERENCE TO RELATED APPLICATION

Figure 1:
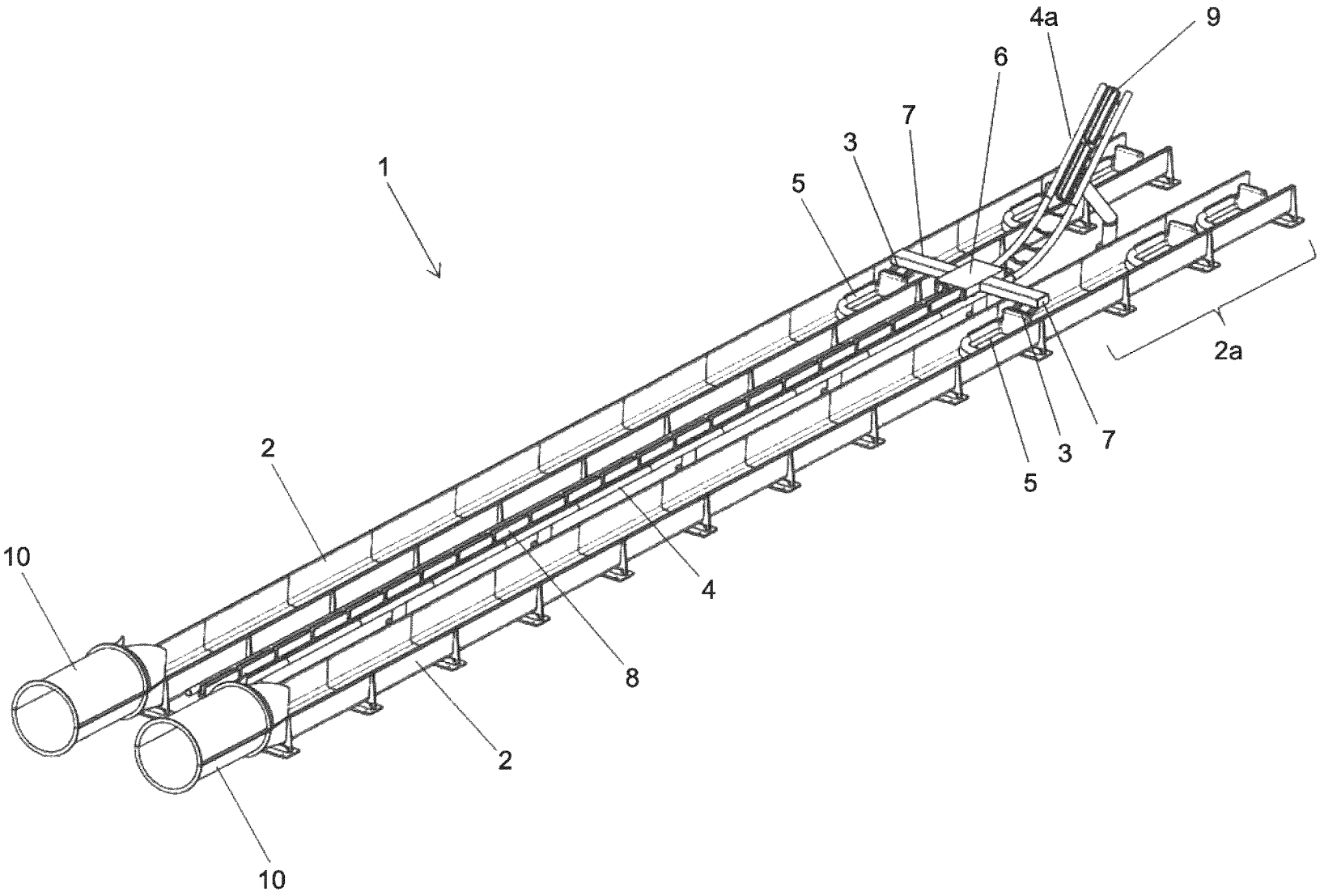

This application is a § 371 national phase application of International Application No. PCT/EP2018/080955, filed Nov. 12, 2018, and entitled "ACCELERATION SECTION FOR A WATER SLIDE," the contents of which being incorporated by reference in their entirety herein.

The present invention relates to an acceleration section for a water slide and to a water slide comprising the same.

Water slides, subsequently also referred to simply as "slides", have become increasingly popular for water parks. In a water slide, a person, also referred to as "slider", moves along a sliding trail from an entry of the slide to an end of the slide either directly on a water film or in a raft gliding on the water film. Typically, the start of the slide is higher than the end of the slide, such that the potential energy of the slider at the start of the slide accelerates the slider and thus increases his kinetic energy.

In this document, the expression "water slide" can mean a body slide in which the slider's body glides immediately on a water film in a sliding trail or a raft slide in which the slider rests on or in a raft which in turn glides on a water film in the sliding trail. In this document, the term "raft" means any kind of slide vehicle, such as a boat, a ring or any other kind of raft. A raft can carry one or more sliders.

In the past years, there have also been developments for accelerating a raft horizontally or even uphill. One concept involves water jets hitting a raft. Another concept uses an electromagnetic field interacting with a suitably equipped raft. The most recent development utilizes an air stream generated in a closed sliding tube, the airstream hitting a backrest of a raft.

The intention of the present invention is providing an alternative acceleration system for a water slide.

The present invention relates to an acceleration section for a water slide, comprising a sliding trail in which a person can slide and a pusher inside the sliding trail, the pusher being configured to accelerate the person inside the sliding trail. In one example, the pusher is accelerated inside the sliding trail, wherein the pusher contacts the slider or the raft, respectively, during the acceleration.

The sliding trail forms the path along which the slider slides. The sliding trail can have any suitable cross section, wherein typical cross-sections of sliding trails are for example U-shaped, semi-circular, circular or elliptic. The sliding trail is typically made of plastic, a composite material or metal. It shall be noted that a sliding trail can be horizontal or inclined towards the horizontal, such that it for example raises upwards during the acceleration.

The acceleration section further comprises an accelerator track outside of the sliding trail, an accelerator car running on the accelerator track and configured to be accelerated along the accelerator track and a coupling unit mechanically coupling the pusher and the accelerator car.

The accelerator track being outside of the sliding trail means that the accelerator track does not lie within the cross-section of the sliding trail. The pusher, the accelerator car and the coupling unit are made of a solid material.

With the above configuration, the sliding trail of the acceleration section can be a regular sliding trail as used for existing water slides without the need for providing additional elements, such as water or air inlets. In addition, the contact between the pusher and the slider or raft, respectively, means that the acceleration, and in particular the speed at the end of the acceleration, of the slider or raft can be exactly controlled. The end speed does then in particular not depend on the weight of the slider. This also reduces the risk of injury of the slider.

With the present invention, the accelerator track can be located at a suitable position, for example above, below or alongside the sliding trail. In one embodiment, the accelerator track is parallel to the sliding trail. The coupling unit can then be a mechanically rigid member since the distance between the accelerator track and the sliding trail remains constant along the length of the sliding trail.

In one embodiment, at least two members out of the pusher, the coupling unit and the accelerator car form an integrated unit, which means that they are a single piece. The coupling unit may be a simple arm reaching from the accelerator car to the pusher inside the sliding trail.

The accelerator track can have any suitable configuration. The accelerator track can for example comprise one or multiple pipes, such as steel pipes, as is known from the track of rollercoasters. If the accelerator track comprises a single pipe, the pipe preferably carries at least one guiding plate along the pipe to prevent the accelerator car from rotating about the pipe.

In one embodiment, the acceleration section further comprises a drive system configured to accelerate the accelerator car along the accelerator track. Exemplary drive systems are those which are also used for rollercoasters, like friction wheels, electromagnetic drive systems or drive systems using one or more ropes for accelerating the accelerator car. Typical electromagnetic drive systems involve LIM (linear induction motor) or LSM (linear synchronous motor) systems. In rope-based systems, the rope is either connected to a piston running inside a cylinder or to a driven drum. The can be driven by any suitable system, such as a hydraulic or pneumatic motor, a flywheel coupled to the drum or an (electric) motor. The drum either guides and pulls the rope or winds up the rope.

In one embodiment, the drive system is configured to accelerate the accelerator car in two opposing directions. With this configuration, the acceleration section can accelerate a first person in first direction and a second person subsequently in the second, opposing direction. Compared to a configuration in which sliders are only accelerated in one direction, the movement of the pusher to a start position at the beginning of the acceleration is not wasted, but used to accelerate another slider. This increases the capacity of the acceleration section in terms of the number of sliders which can be accelerated in a particular period of time, but also allows to accelerate sliders onto two different sliding paths at the two opposing ends of the acceleration section.

In one embodiment, the pusher comprises at least one wheel rolling on the sliding trail. This wheel supports the weight of the pusher, which means that the coupling unit and the accelerator car do not have to carry (all) the weight of the pusher. This is particularly advantageous if the pusher and the coupling unit exert a moment on the accelerator car. The wheel can reduce or even eliminate this moment.

In one example, the pusher comprises one or more side wheels for guiding the pusher within the sliding trail in a direction perpendicular to the direction of the acceleration, such as a horizontal direction.

With the present invention, the accelerator car is accelerated in the same direction as the pusher and thus the person being accelerated by the pusher.

In one embodiment, the pusher includes a tongue supporting the person and being guided on the sliding trail.

"Supporting the person" means that the person for example sits or lies on the tongue or that the raft lies on the tongue. In this embodiment, the person or raft, respectively, is not in contact with the sliding trail during acceleration, but rests (more or less) static on the tongue. This reduces the wear of the raft or the risk of injury of the person in case of a body slide.

The tongue for example comprises at least one water outlet through which water flows onto the surface of the tongue which supports the person. In one embodiment, the water outlet is connected to a water inlet via a pipe, wherein the water inlet is located at the front or the bottom of the tongue and picks up water flowing in the sliding trail. This water decreases friction between the tongue and the person or the raft, respectively.

In one embodiment, the tongue comprises at least one biasing member, such as a spring, for biasing the tongue towards the bottom of the sliding trail. This prevents any gap between the tongue and the sliding trail, and thus makes the transition of the person from the tongue onto the sliding trail at the end of the acceleration more comfortable.

In one embodiment, the pusher further comprises a passenger cabin limiting the freedom of movement of the person during the acceleration. The passenger cabin prevents the person from reaching out of the sliding trail and/or into gaps, for example between the sliding trail and components like the pusher or the tongue. This reduces the risk of injury of the slider. The accelerator track may have a braking area for the accelerator car, wherein this braking area is not necessarily parallel to the sliding trail. In the braking area, the accelerator car is braked after the slider was accelerated. The accelerator car can then move back to the starting position of the acceleration to accelerate another slider or accelerate a slider in the opposite direction as explained above.

In one embodiment, the braking area of the accelerator track is inclined upwards compared to the rest of the accelerator track. The accelerator car is then braked due to gravity and is even accelerated in the opposite direction, towards the start position of the acceleration.

If the sliding trail is for example a tube, it has an opening extending in the direction of the acceleration such that the coupling unit can reach from the accelerator car into the sliding trail. The opening is for example at the highest point or the apex of the tube.

In one embodiment, the acceleration section comprises a feeding section configured to move the person into the sliding trail. This is particularly useful if a raft carrying the slider has to be accelerated. Instead of manually placing the raft in the sliding trail and then entering the raft, the raft can be fed into the sliding trail with the slider already in place. The purpose of the feeding section is bringing the slider into the start position at which the acceleration begins.

In one embodiment, the feeding section comprises an area in which the pusher is moved out of the sliding trail such that the slider or the raft can be moved forwards in the sliding trail until he/it is positioned in front of the pusher. The pusher is then brought back into the sliding trail and can accelerate the person or raft.

In another embodiment, the feeding section comprises a ramp or lift which leads the slider or the raft into the sliding trail from below the sliding trail. Once the slider or raft is located in the sliding trail, the pusher moves forward until it contacts the slider or raft.

In the above embodiments, the slider or raft can be brought into the start position by appropriate means, such as a conveyor belt, a water stream or a downward slope of the sliding trail.

In one embodiment, the feeding mechanism comprises a carriage which laterally moves the person or the raft into the sliding trail. The carriage may comprise at least one wall segment which forms a part of a side wall of the sliding trail once the person or raft is inside the sliding trail.

In one embodiment, the acceleration section further comprises a control unit for controlling the drive system and an input unit for inputting commands to the control unit, wherein the control unit is configured to control the acceleration caused by the drive system according to user input of the person to be accelerated. Controlling the acceleration here means controlling one or both of the intensity of the acceleration and the end speed at the end of the acceleration. By controlling the end speed, the slider can decide how fast he is accelerated by the acceleration section. He can thus control the intensity of his slide experience, for example the height he reaches in subsequent slide element, such as a halfpipe element. By controlling the acceleration intensity, the slider can for example adjust whether there is a very short, but intense acceleration or a rather moderate acceleration along the whole length of the sliding trail of the acceleration section.

In one embodiment, the control unit is further configured to control lighting equipment installed along or inside the sliding trail. In one implementation, the lighting scheme produced by the lighting equipment depends on the acceleration profile selected by the slider.

In one embodiment, the control unit is further configured to control sound equipment installed along or inside the sliding trail. In one implementation, the sound scheme produced by the sound equipment depends on the acceleration profile selected by the slider.

In one embodiment, the acceleration section further comprises at least one additional sliding trail parallel to the sliding trail, an additional pusher in each additional sliding trail and an additional coupling unit for each additional pusher, wherein each additional coupling unit mechanically couples the associated additional pusher to the accelerator car. In this embodiment, the same accelerator car, accelerator track and drive system can be used to accelerate multiple pushers, thus increasing the capacity of the water slide while reducing the cost by re-using existing components. In this embodiment, the multiple sliding trails can for example be arranged next to each other, above each other or a combination thereof.

In one embodiment, the pusher comprises at least one shoulder contact member for contacting a shoulder of the person in the sliding trail. In one implementation, there are two shoulder contact members having a clearance for the head of a slider between them. The force exerted by the pusher while accelerating the slider thus acts on the slider's shoulders. This is in particular useful if the water slide is a body slide.

In one embodiment, when the water slide is a raft slide, at least a part of the pusher has a surface which forms a form fit with at least a part of the raft or the pusher has a surface for contacting the raft, the surface being inclined towards the bottom of the sliding trail. This embodiment prevents lifting off of the raft during the acceleration and stabilizes the raft during acceleration.

In the form fit, the pusher can for example have a frustum for engaging with a corresponding recess in the raft.

The surface of the pusher being inclined towards the bottom of the sliding trail means that the surface normal of this surface is not parallel to the direction of the acceleration, but inclined towards the bottom of the sliding trail, wherein the bottom of the sliding trail is the part of the sliding trail on which the raft slides.

In one embodiment, the pusher comprises a coupler for mechanically coupling the pusher and the raft. The coupler can be mechanical, such as a hook which releases at the end of the acceleration, or an electromagnet which interacts with a counterpart in the raft.

In one embodiment, the acceleration section comprises nozzles forming water outlets which cause a water film in the sliding trail. This reduces friction of the slider or raft being accelerated. The nozzles can be located in the bottom of the sliding trail and/or in one or more side walls of the sliding trail. The nozzles can also be located at the top of the sliding trail or above the sliding trail, thus for example forming a water curtain.

In one embodiment, the acceleration section further comprises a raising mechanism for raising the pusher out of the sliding trail.

In one embodiment, the raising mechanism involves a slanted part of the accelerator track. In particular, the accelerator track raises upwards compared to the sliding trail. If the accelerator car runs on the slanted part of the accelerator track, it is lifted upwards, thus raising the pusher out of the sliding trail via the coupling unit.

In another embodiment, the raising mechanism comprises a lever which lifts the pusher out of the sliding trail. The lever can be operated by a drive, such as a motor or a hydraulic or pneumatic cylinder. In another implementation, a guidance for the lever is provided which lifts the lever, and thus the pusher, if the accelerator car moves along the accelerator track.

The present invention further relates to a water slide comprising the acceleration section as explained above. The water slide further comprises a subsequent sliding trail in which the person can slide after the acceleration. The subsequent sliding trail may be a regular sliding trail or comprise one or more particular elements, such as a halfpipe element, a loop, a funnel or a bowl.

The water slide may comprise subsequent sliding trails at both ends of the acceleration section. The subsequent sliding trails at the two ends may be different.

It lies within the scope of the present application to combine two or more embodiments as long as this is technically feasible.

In the following, the invention is described with reference to the enclosed figures which represent preferred embodiments of the invention. The scope of the invention is not however limited to the specific features disclosed in the figures, which show FIG. 1 a three-dimensional view of an acceleration section, FIG. 2 a top view onto the acceleration section of FIG. 1, FIG. 3 a cross-sectional view of the acceleration section of FIG. 1, FIG. 4 a detail of the acceleration section of FIG. 1, FIG. 5 another detail of the acceleration section of FIG. 1, FIG. 6 a cross-sectional side view of an acceleration section, FIG. 7 a cross-sectional side view of the acceleration section of FIG. 6 with the pusher engaging the raft, FIG. 8 pushers with tongues for supporting the raft, FIG. 9 pushers with two shoulder contact members, FIG. 10 a three-dimensional view of a mechanism for raising the pusher, FIG. 11 a cross-sectional frontal view of the mechanism of FIG. 10, FIG. 12 a cross-sectional side view of the mechanism of FIG. 10, FIG. 13 a feeding section for feeding a raft from below, FIG. 14 a feeding section for feeding a raft from the side in a first state, FIG. 15 the feeding section of FIG. 14 in a second state and FIG. 16 a functional block diagram of the acceleration section.

FIG. 1 shows a schematic three-dimensional view of an acceleration section 1 for a water slide. The embodiments described subsequently show an acceleration section 1 for simultaneously accelerating two rafts, wherein each raft can carry one or more persons. In the drawings, the persons are omitted for simplifying the illustrations.

The twin arrangement shown in the drawings increases capacity of the acceleration section 1 and also has the advantage of a symmetric design which can make the structure of the acceleration section more simple. However, the present invention equally applies to an acceleration section for accelerating a single raft or more than two rafts simultaneously. Each of the rafts accelerated simultaneously is accelerated in a separate sliding trail 2 by an associated pusher 3. In addition, instead of a raft, a person directly lying, sitting, kneeling or standing in a sliding trail 2 can be accelerated.

The acceleration section 1 shown in FIG. 1 comprises two sliding trails 2 which are parallel to each other and have a basically U-shaped cross-section formed by a bottom and two side walls. A pusher 3 is arranged inside each sliding trail 2, wherein each pusher 3 is configured to accelerate a raft 5 inside the sliding trail.

An accelerator track 4 is arranged inbetween the two sliding trails 2, and thus outside of all sliding trails. The accelerator track 4 carries an accelerator car 6 which is accelerated along the accelerator track 4 using a drive system 8. In the present example, the drive system 8 uses electromagnetic stators along the accelerator track 4 which interact with permanent magnets or a magnetizable element in the accelerator car 6. It shall be noted that any other suitable drive system other than the electromagnetic drive system shown in the drawings can be used for accelerating the accelerator car 6 along the accelerator track 4.

The two pushers 3 are connected to the accelerator car 6 via coupling units 7. First ends of the coupling units 7 are attached to the accelerator car 6. The coupling units 7 reach over the inner side walls of the sliding trails 2, while the pushers 3 are attached to the coupling units 7 at or near second ends of the coupling units 7, such that the pushers 3 extend into the sliding trails 2. The second ends of the coupling units 7 are opposite to the first ends of the coupling unit 7. An inner side wall of a sliding trail 2 is the side wall closer to the accelerator track 4 than the other side wall.

The accelerator track 4 has a rear extension 4*a* which is not parallel to the sliding trails 2, but raises upwards. The extension 4*a* of the accelerator track 4 optionally comprises a holding brake 9 for holding the accelerator car 6 on the extension 4*a*.

In this document, the expressions "rear" or "rear end" indicate the end of the acceleration section 1 at which the acceleration starts and the expression "front" or "front end" means the end of the acceleration section 1 at which subsequent sliding trails 10 into which the rafts are accelerated connect to the acceleration section 1.

At the rear ends of the sliding trail 2, waiting areas 2*a* are connected to the sliding trails 2. The waiting areas 2*a* can hold one or more rafts waiting to be accelerated.

FIG. 1 shows the acceleration section 1 in a state ready for accelerating two rafts 5. In the state shown in FIG. 1, the two pushers 3 are in contact with the backrests of the rafts 5. Upon operation of the acceleration section 1, the drive system 4 accelerates the accelerator car 6 along the accelerator track 4 in a direction from the rear end to the front end of the acceleration section 1. This acceleration of the accelerator car 6 is transmitted to the rafts 5 via the coupling units 7 and the pushers 3. At the end of the acceleration process, the accelerator car 6 is braked, such that the rafts 5 disengage from the contact with the pushers 3 due to their inertia. The rafts 5 then continue their movement into the subsequent sliding trails 10.

The accelerator car 6 is then moved backwards towards the rear end of the acceleration section 1. In the example shown in FIG. 1, the accelerator car is moved backwards beyond the starting point of the acceleration and onto the extension 4*a* of the accelerator track 4, where it is held by the holding brake 9. In this state, a new raft 5 waiting in the waiting area 2*a* behind each of the sliding trails 2 is moved forwards, passing under the raised pushers 3, to the start position shown in FIG. 1. The holding brake 9 stops holding the accelerator car 6 and the accelerator car 6 is slowly moved forwards until the pushers 3 are in contact with the rafts 5 which are ready for acceleration.

When the accelerator car 6 moves backwards and up the extension 4*a* of the accelerator track 4, the pushers 3 are lifted out of the sliding trails 2, such that the waiting rafts 4 can move forward beneath the raised pushers 3.

Towards the front of the acceleration section, the accelerator car 6 is braked as explained above. This braking process is for example performed by the drive system 8.

In an embodiment not shown in the drawings, the accelerator track 4 has an additional front extension similar to the extension 4*a* at the rear end of the acceleration section 1. This additional front extension is also raised upwards, thus braking the accelerator car 6 using gravity. At the front extension, the accelerator car 6 moves upwards, thus slowing down. At the top dead center, the direction of travel of the accelerator car 6 changes, such that the car moves back downwards and towards the rear end of the acceleration section 1.

Figure 2:
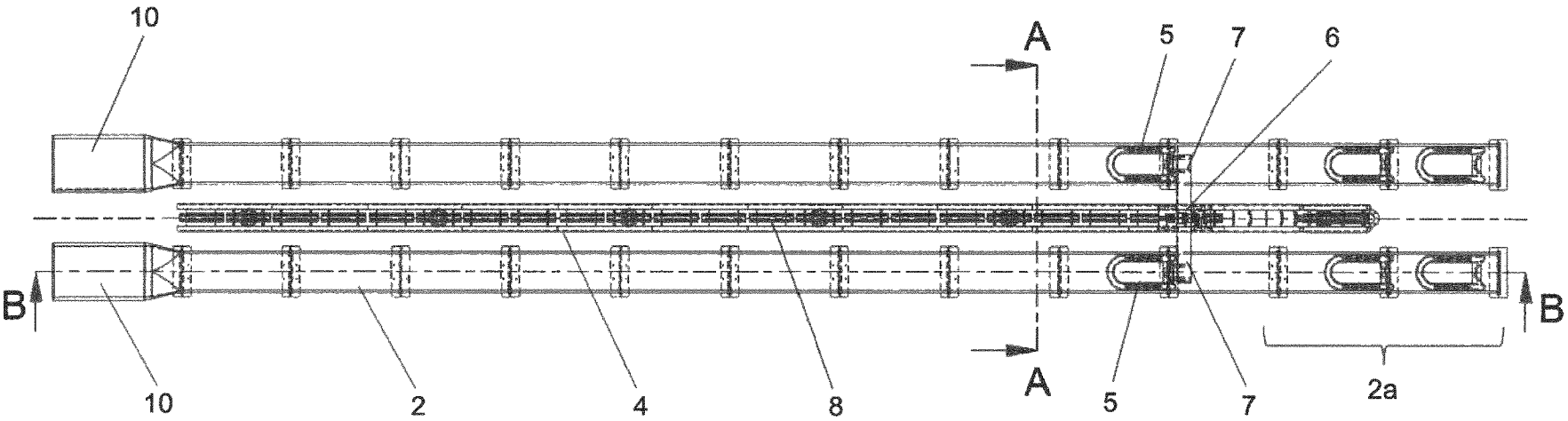

FIG. 2 shows a top view of the acceleration section 1 of FIG. 1. As can be seen from FIG. 2, the accelerator track 4 is located in the middle between the two sliding trails 2. This has the advantage of a potential symmetric design of the accelerator car 6, the coupling units 7 and the pushers 3, thus reducing stress on the accelerator car 6 and the accelerator track 4. However, the arrangement does not have to be symmetric, for example depending on the location where the acceleration section is to be installed.

Figure 3:
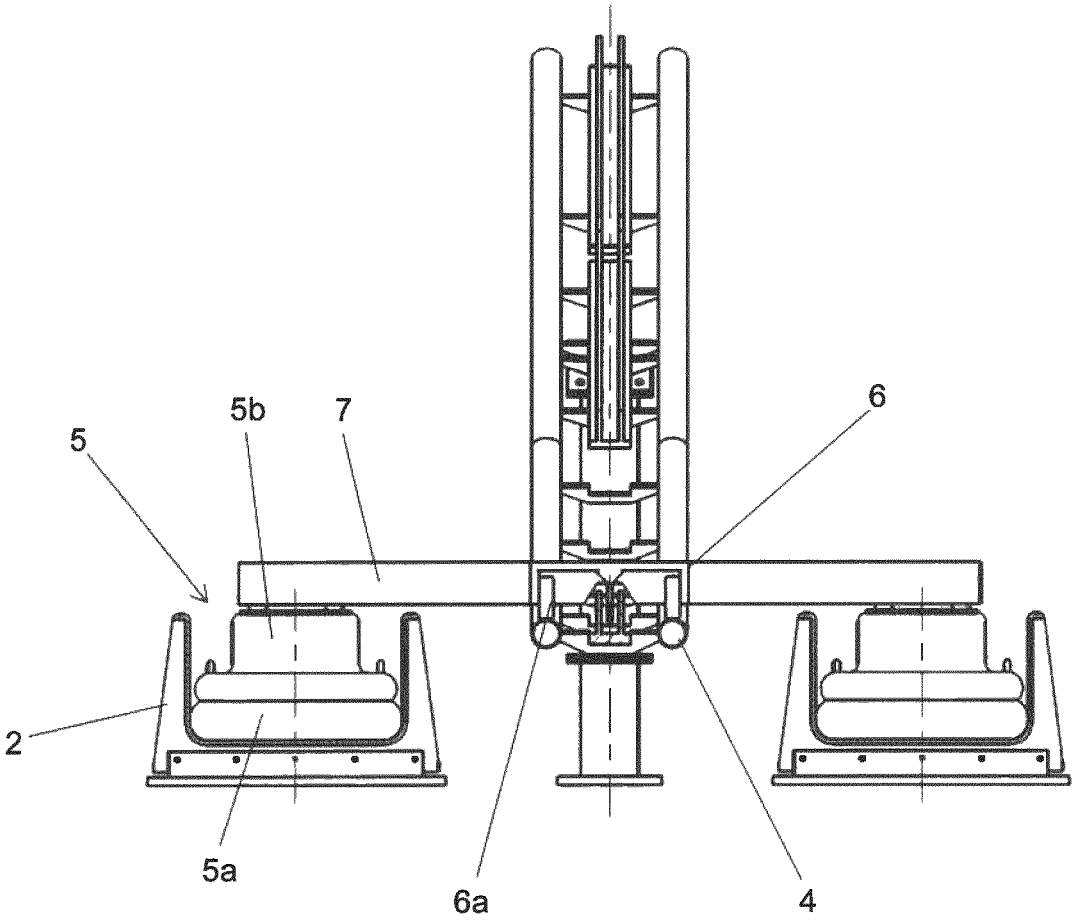

FIG. 3 shows a frontal cross-sectional view along the line A-A indicated in FIG. 2. As can be seen from FIG. 3, the coupling units 7 reach over the inner side walls of the sliding trails 2. The accelerator track 4 in the present embodiment is a two-pipe track as it is known from rollercoasters, for example. The two pipes are connected to each other via a set of ties. The accelerator track 4 rests on a number of supports.

The accelerator car 6 has an appropriate number of bogies, such that the accelerator car 6 can move on the accelerator track 4. The bogies at least comprise running wheels running on top of the accelerator track 4 and supporting the weight of the accelerator car 6, the coupling units 7 and the pushers 3. The bogies can further comprise up-stop wheels and/or side wheels as desired. Side wheels guide the accelerator car 6 laterally on the accelerator track 4. Up-stop wheels prevent the accelerator car 6 from vertically lifting off of the accelerator track 4.

As can also be seen from FIG. 3, a raft 5 comprises a raft body 5*a* and a backrest 5*b*. The body 5*a* glides on a water film in the sliding trail 2. The lateral width of the raft body 5*a* is identical or slightly lower, such as by 1, 2, 5 or 10%, than the inner lateral width of the sliding trail 2. This guides the raft 5 inside the sliding trail and prevents a lateral motion during acceleration.

Figure 4:
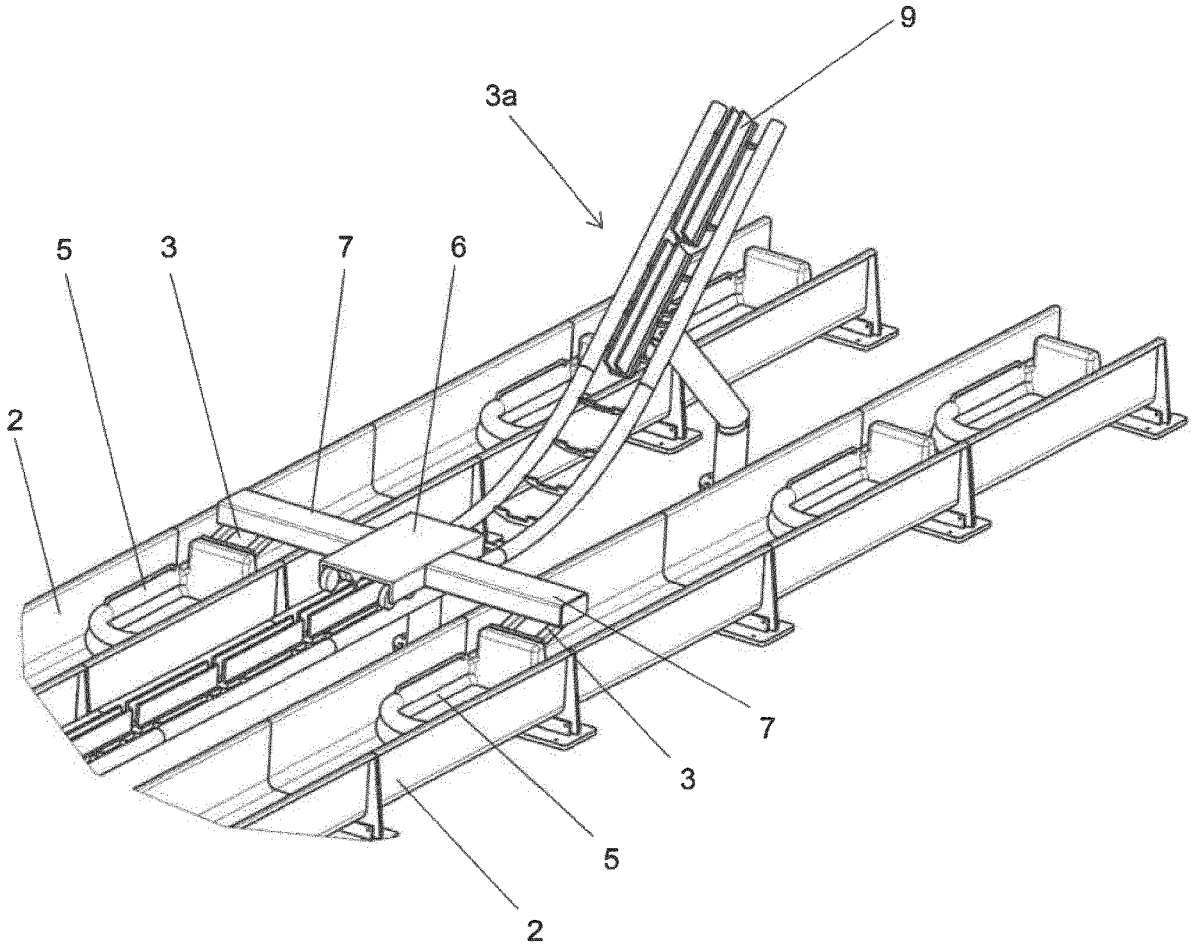

FIG. 4 is an enlarged view of the rear part of the acceleration section 1 shown in FIG. 1, FIG. 4 shows the running wheels of the accelerator car 6 as well as the pushers 3 in more detail. It further shows that the rear extension 4*a* of the accelerator track 4 has a straight part carrying the brakes 9 and a bent part connecting the straight part to the accelerator track 4.

Figure 5:
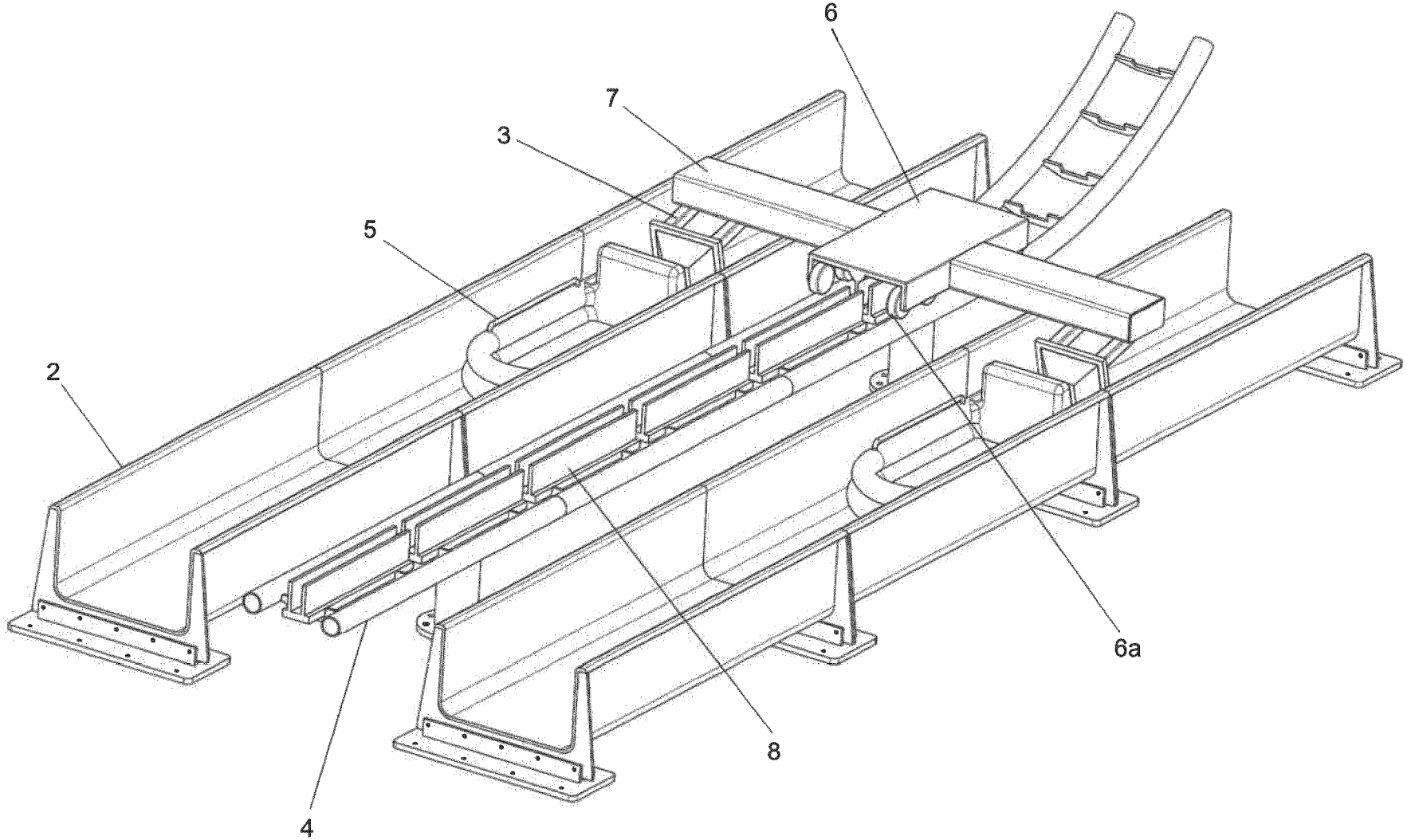

FIG. 5 shows the acceleration section of FIG. 1 in a state before the pushers 3 contact the backrests 5*b* of the rafts 5. As can be seen from FIG. 5, a pusher 3 of the present embodiment has a part in the shape of a frustum. The backrest 5*b* of a raft 5 has a recess having the inverse shape of this frustum. There is thus a form fit between the pusher 3 and the raft 5.

A frustum has two flat, parallel surface areas. In the present embodiment, the normal vector being orthogonal to those two flat surface areas is inclined towards the bottom of the sliding trails 2 compared to the direction of movement of the accelerator car 6 along the accelerator track 4. This results in a force pushing the rafts 5 towards the bottom of the sliding trails 2, thus preventing the rafts 5 from lifting off.

Figure 6:
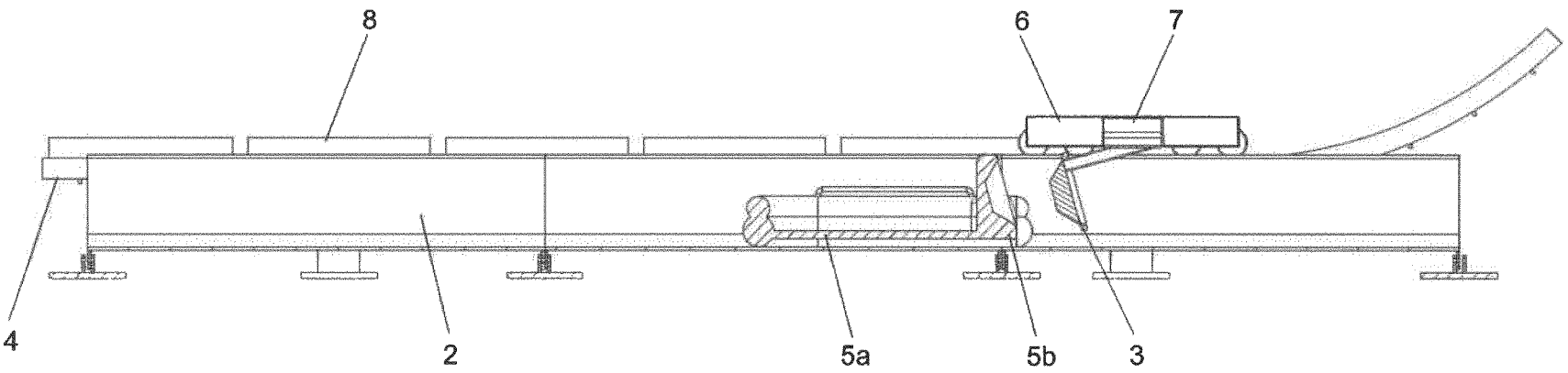
Figure 7:
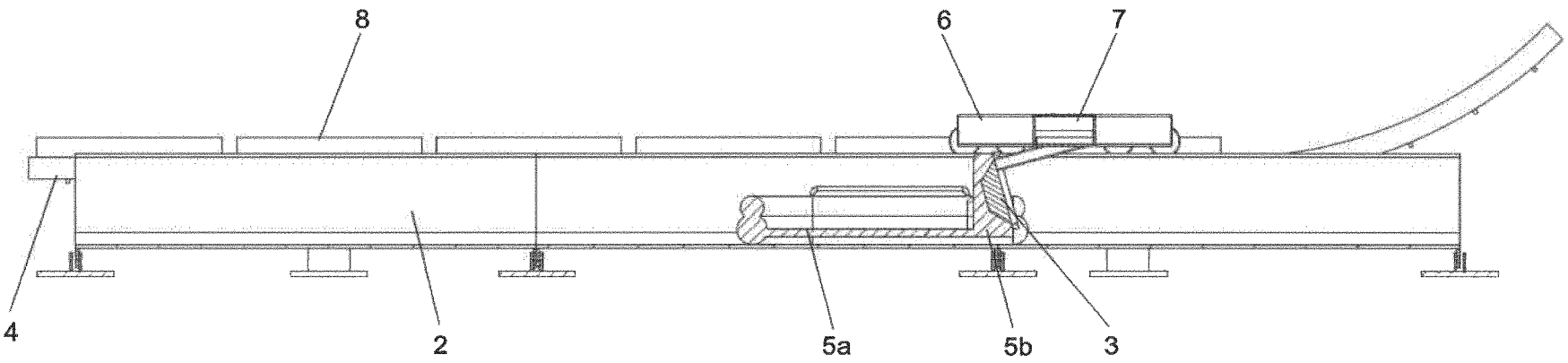

FIGS. 6 and 7 show cross-sectional views along the line B-B shown in FIG. 2. They show the pushers 3 before and after contacting the backrests 5*b* of the rafts 5, respectively. The frustum shape of a part of the pusher 3 in combination with corresponding recess in the backrest 5*b* of the raft 5 has the effect that that the pusher 3 is self-centering in the recess in the backrest 5*b*.

In FIGS. 6 and 7, the raft 5 is in its start position for the acceleration. Between the states shown in FIGS. 6 and 7, respectively, the accelerator car 6 is slowly moved forwards towards the raft 5 until the pusher 3 is in contact with the raft 5. The accelerator car 6 can then accelerate the raft 5 without stopping or could rest in the contact position shown in FIG. 7 for a while before the acceleration starts.

Figure 8:
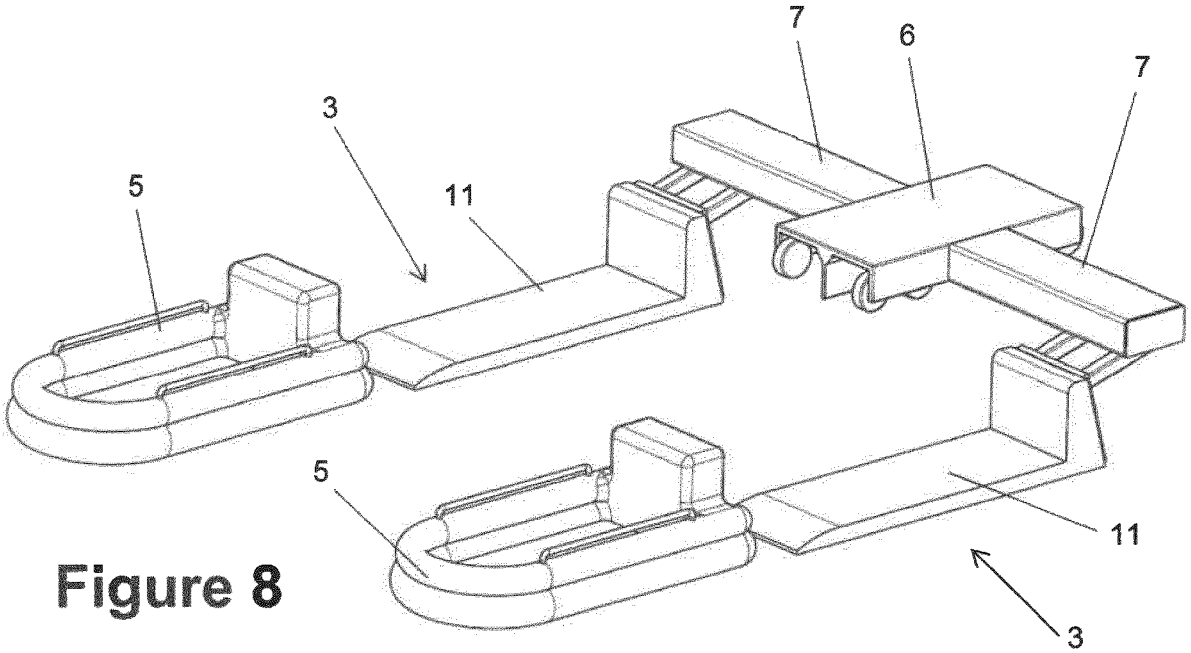

FIG. 8 shows an accelerator car 6 with two coupling units 7 and two pushers 3 for use in a raft slide. Each pusher 3 comprises a tongue 11 for supporting a raft 5. During acceleration, the raft 5 remains on the tongue 11 and does thus not glide on a water film in the sliding trail 2. This prevents a lateral motion of the raft 5 during the acceleration. At the end of the acceleration, the accelerator car 6, and thus the pusher 3 having the tongue 11, is braked, which means that the raft 5 slides off of the tongue 11 due to its inertia. This state is shown in FIG. 8.

Figure 9:
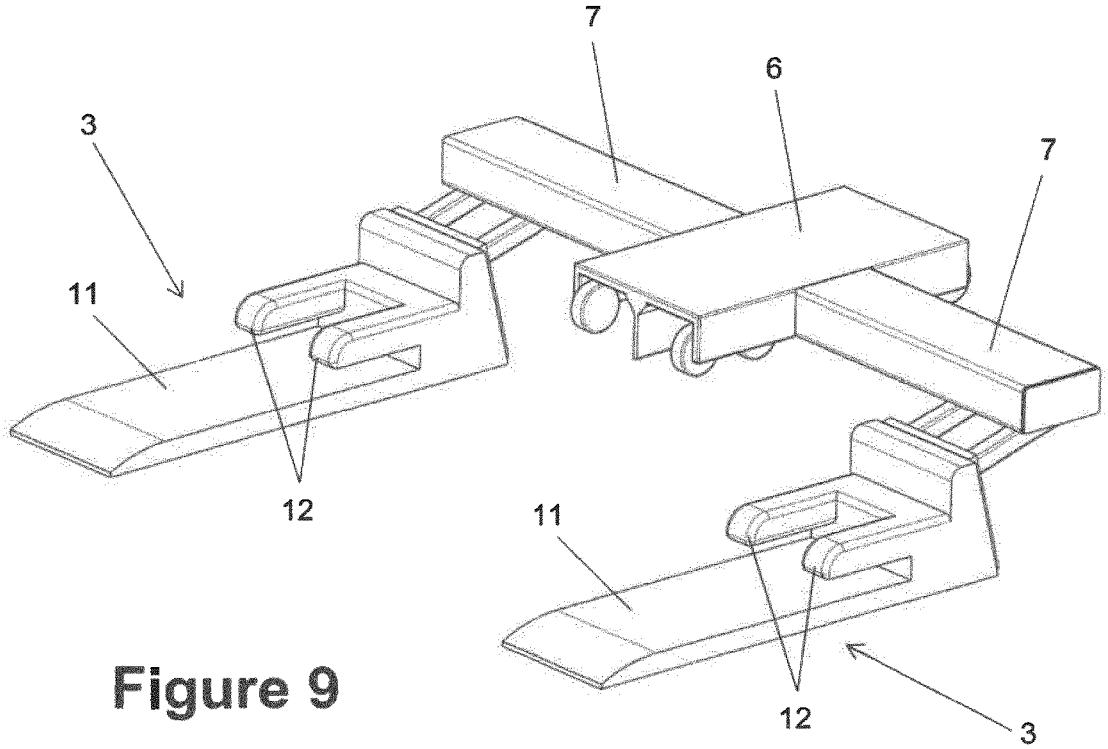

FIG. 9 shows an accelerator car 6 with two coupling units 7 and two pushers 3 for use in a body slide. The pushers 3 each comprise two shoulder contact members 12 pushing against the slider's shoulders to accelerate him in the acceleration section 1. Between the shoulder contact members 12, there is a recess for conveniently accommodating the slider's head during the acceleration.

In the embodiment shown in FIG. 9, the slider lies on a tongue 11 for supporting the slider during the acceleration. The slider rests on the tongue 11 during the acceleration and further contacts the shoulder contact members 12 with his shoulders to prevent undesired backwards motion of the slider on the tongue 11. However, the tongue 11 can be omitted, such that the slider glides on a water film in the sliding trail 2.

In the embodiment shown with regards to FIGS. 1 to 7, the pushers 3 are lifted out of the sliding trail 2 due to an upwards movement of the accelerator car 6 on the extension 4*a* of the accelerator track. In an alternative embodiment, there is no extension 4*a* raising upwards. In this alternative, the pusher 3 is moved relative to the accelerator car 6, for example via a lever mechanism.

Figure 10:
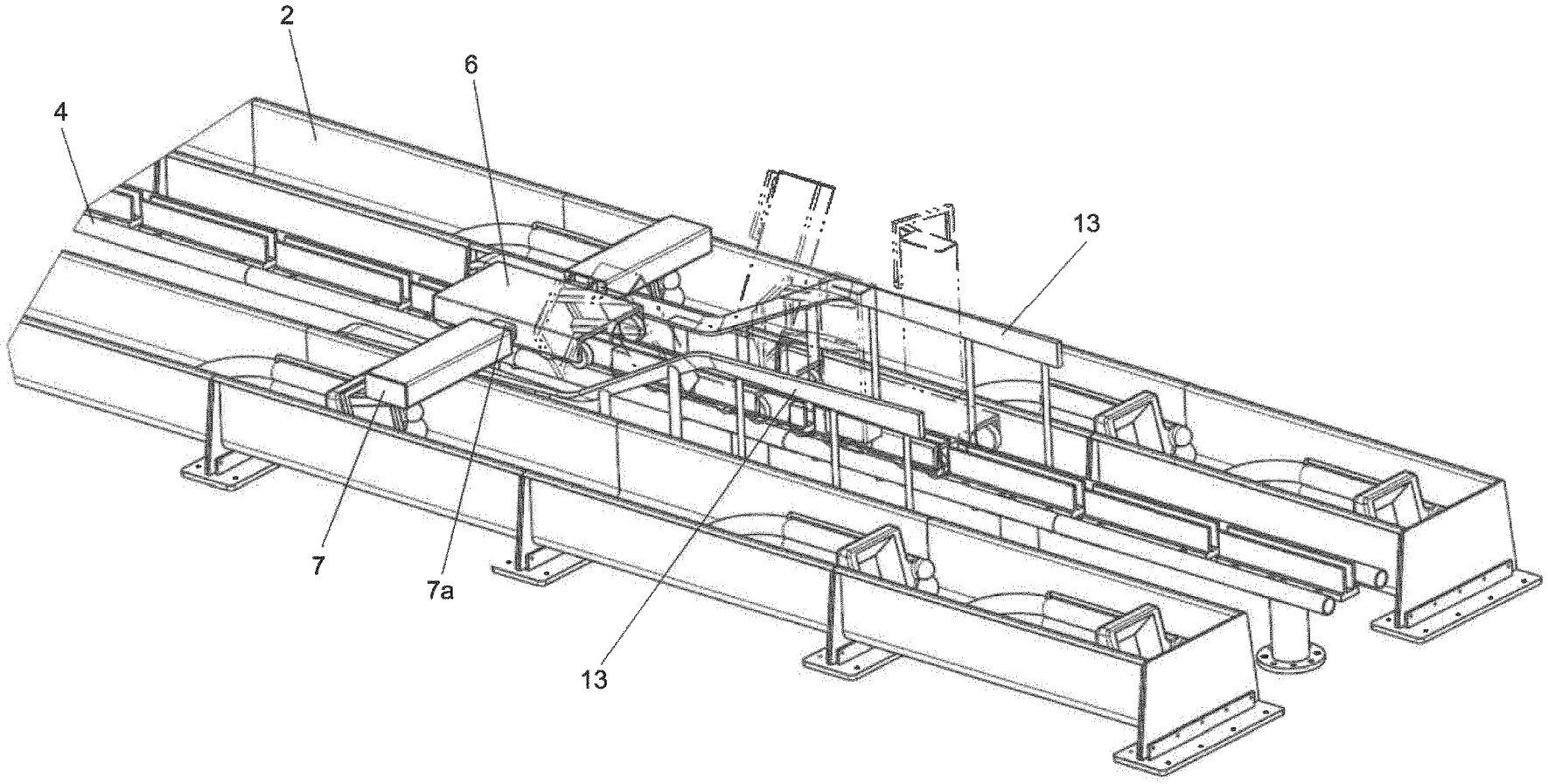
Figure 11:
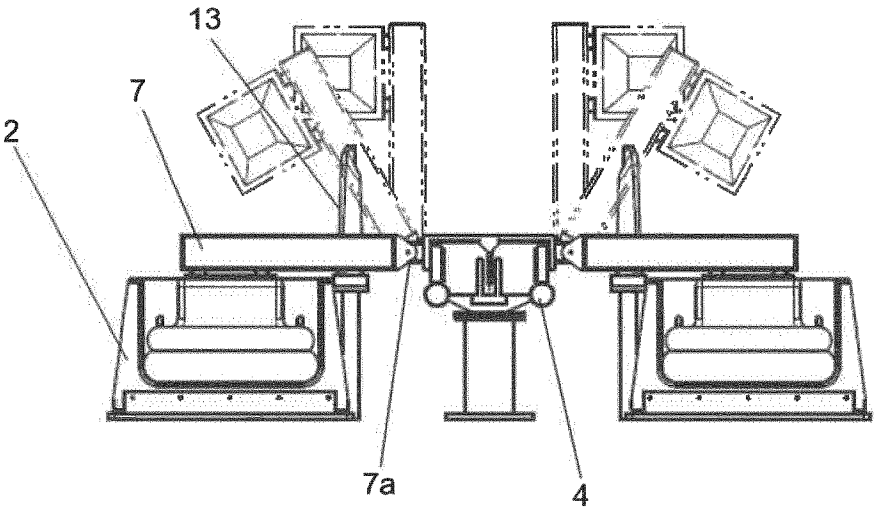
Figure 12:
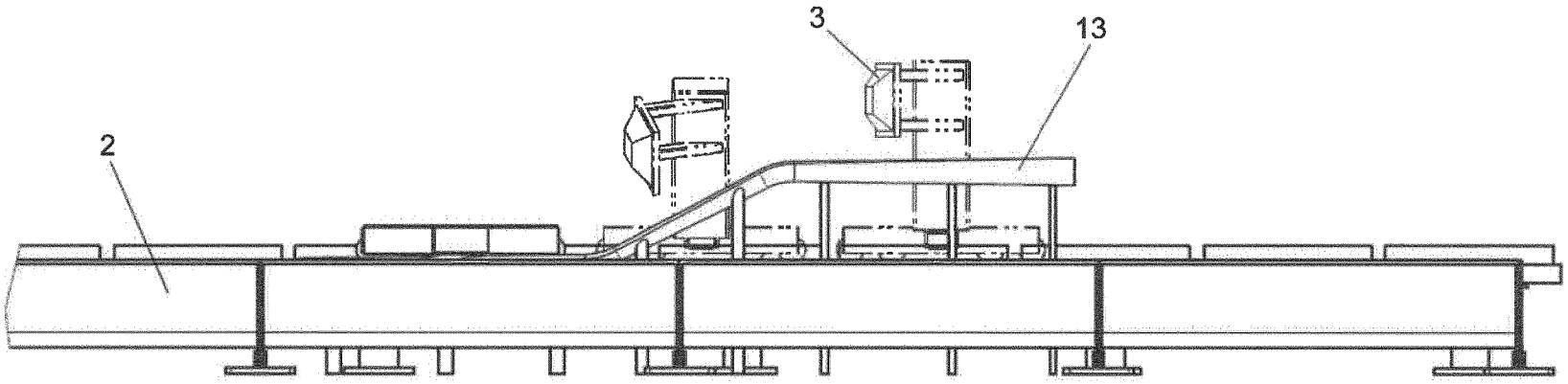

In the embodiment shown in FIGS. 10 to 12, there is an axis of rotation between the accelerator car 6 and the pusher 3. The axis of rotation is for example parallel to the direction of movement of the accelerator car 6 along the accelerator track 4. The axis of rotation can be located at the connection between the accelerator car 6 and the coupling unit 7, within the coupling unit 7, at the connection of the coupling unit 7 and the pusher 3 or a combination thereof. The pusher 3 is lifted out of the sliding trail 2 by a rotation about this axis of rotation. The axis of rotation is implemented using a joint or hinge 7*a*. In the present embodiment, the joints or hinges 7*a* are provided between the accelerator car 6 and the coupling units 7.

This rotation can be caused by a dedicated drive system, such as a winch, an electric motor, a pneumatic cylinder or a hydraulic cylinder.

The embodiment of FIGS. 10 to 12 shows another example in which a part of the coupling unit 7 glides on a gliding surface 13. FIG. 10 is a three-dimensional view of the raising mechanism, FIG. 11 is a cross-sectional frontal view and FIG. 12 is a cross-sectional lateral view.

This gliding surface 13 raises in a direction from the front end to the rear end of the acceleration section 1, such that the pusher 3 is lifted out of the sliding trail 2 if the accelerator car 6 moves backwards in an area where the gliding surface 13 is provided. The gliding surface 13 can be a part of the inner side wall of the sliding trail 2 or be provided separate therefrom.

FIGS. 10 to 12 show the coupling units 7 and the pushers 3 in three different states. In the first state, in which the coupling units 7 and the pushers 3 are shown in solid lines, the pushers 3 rest inside the sliding trails 2. In the second state, the accelerator car 6 is moved backwards compared to the first state and the coupling units 7 are halfway on a rising part of the gliding surface 13, such that they are partly lifted. In the third state, the accelerator car 6 is moved backwards even further, such that the pushers 3 are fully lifted. In the second and third states, the coupling units 7 and the pushers 3 are drawn in chain dotted lines.

In the third state, but also in the second state, the pushers 3 are lifted out of the sliding trails 2 such that rafts 5 can move forwards inside the sliding trails 2 without interfering with the pushers 3.

Figure 13:
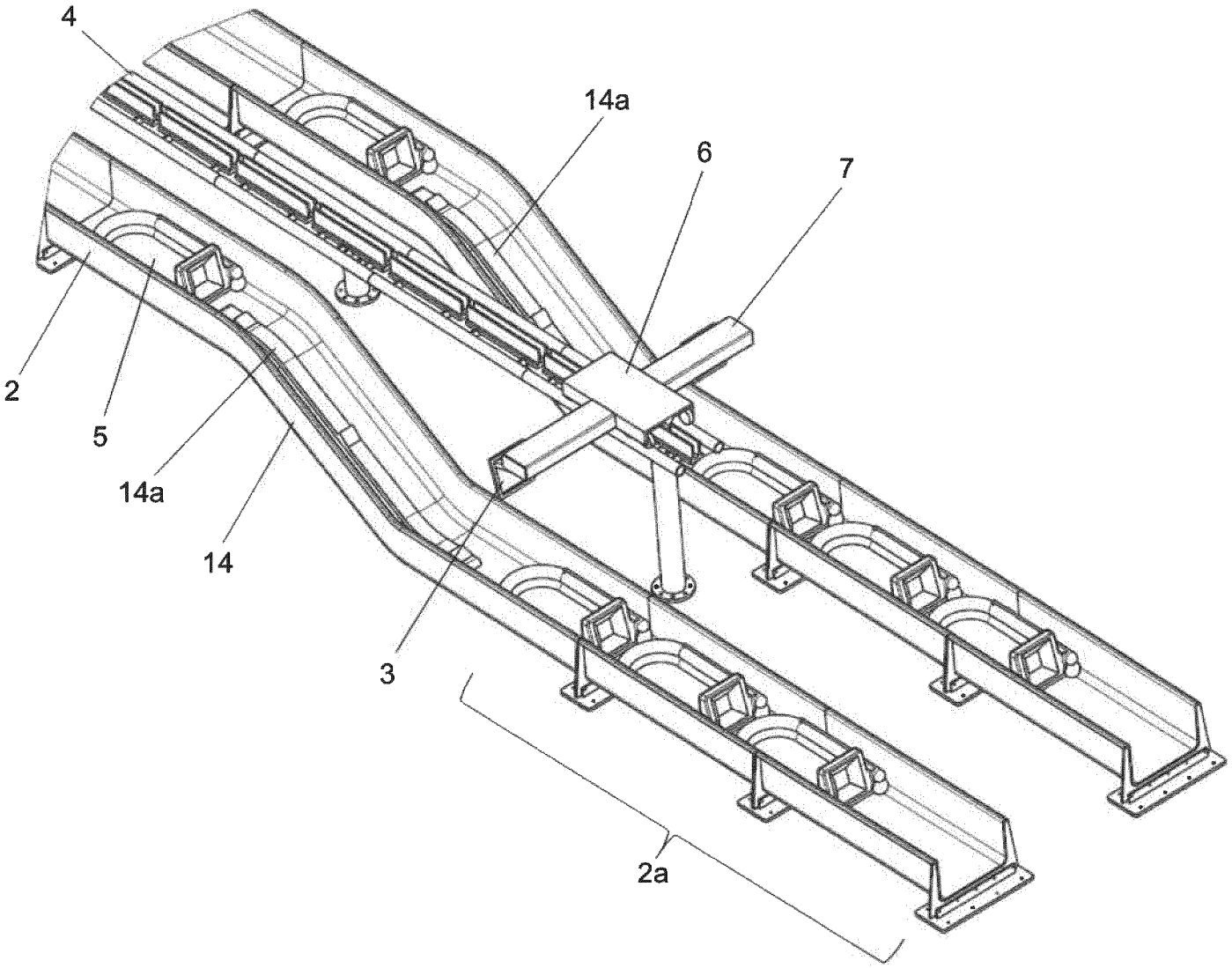
Figure 14:
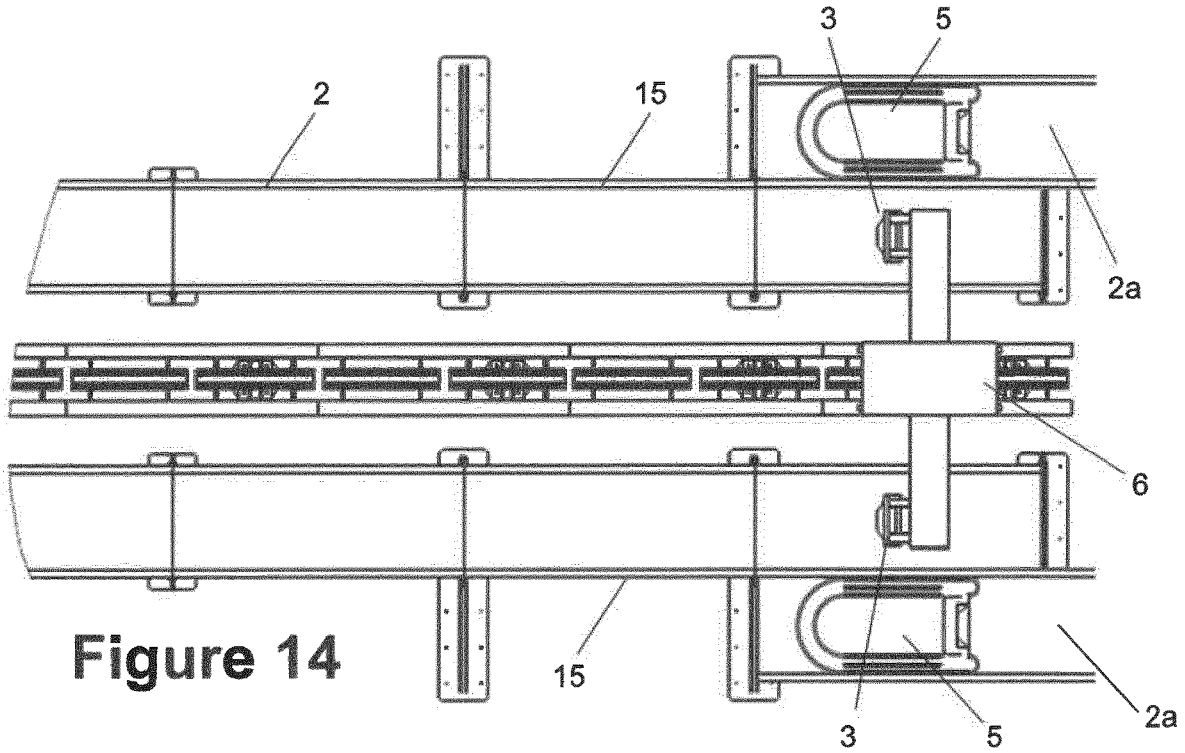

In the embodiment shown with regards to FIGS. 1 to 7, the waiting area 2*a* is a rearwards extension of the sliding trail 2. This does, however, require to lift the pusher 3 out of the sliding trail 2. FIGS. 13 and 14 show alternative feeding sections for bringing a raft 5 into a start position for the acceleration.

FIG. 13 shows an embodiment of a feeding section moving the raft 5 into the start position in the sliding trail 2 from below. A ramp 14 is provided with a conveyor belt 14*a* which moves the raft 5 up the ramp 14 until it reaches the starting position. A plurality of rafts 5 are waiting in the waiting area 2*a* and are moved into the start position one after the other. The accelerator car 6 is waiting behind the ramp 14 while a raft 5 is moved up the ramp 14 such that it does not interfere with the movement of the raft 5. The accelerator car 6 is moved forwards along the accelerator track 4 once the raft 5 is in the start position until it is in contact with the raft 5. Instead of a ramp 14 having a conveyor belt, a vertical lift could be used.

Figure 15:
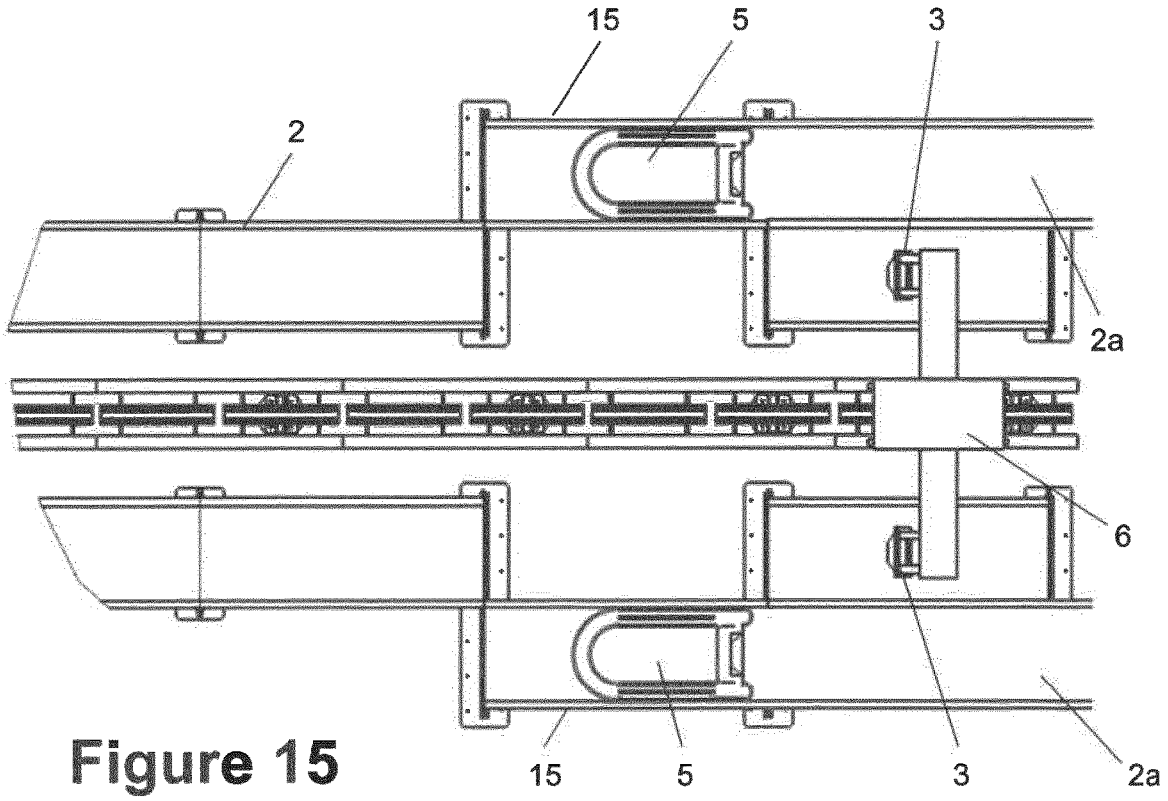

FIGS. 14 and 15 show top views of an alternative feeding section using carriages 15 which move the rafts 5 horizontally into the sliding trails 2. The carriages 15 each carry a part of a sliding trail 2. The carriages 15 move between a first position shown in FIG. 14 and a second position shown in FIG. 15.

In the first state of the feeding section as shown in FIG. 14, the carriages 15 are in their first positions. In those first positions, the parts of the sliding trails 2 carried by the carriages 15 each connect to two other sections of the sliding trails 2. In this state, the accelerator car 6 can move backwards behind the part of the sliding trails 2 carried by the carriages 15 within the sliding trail 2. Rafts 5 are waiting in waiting areas 2*a* of the acceleration section 1.

In the second state of the feeding section as shown in FIG. 15, the carriages 15 are in their second position. In those second positions, the parts of the sliding trails 2 carried by the carriages 15 connect to the waiting areas 2*a*, respectively. In this state, the rafts 5 waiting in the waiting areas 2*a* can move into the parts of the sliding trails 2 carried by the carriages 15. The carriages 15 can then move into their first positions. The accelerator car 6 can then move forward such that the pushers 3 contact the rafts 5 in preparation of the acceleration.

The embodiment shown in FIGS. 14 and 15 is particularly useful if the acceleration section 1 can accelerate rafts 5 in both directions, because the sliding trails 2 can be closed in the complete acceleration section 1.

Figure 16:
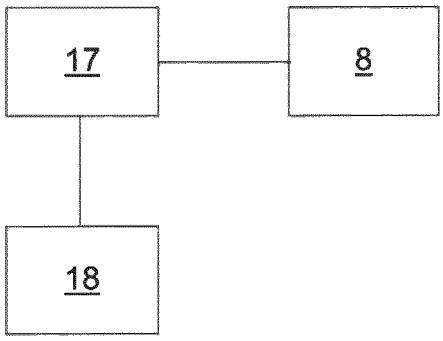

FIG. 16 shows a schematic block diagram of the electric and electronic components of the acceleration section 1. A control unit 17 is operatively coupled to the drive system 8 and an input unit 18. The input unit 18 allows a slider to input data into the control unit 17. The control unit 17 controls the drive system 8, either by directly controlling drive units of the drive system 8 or by providing control data to an internal control system of the drive system 8.

The input unit 18 can be any suitable kind of input unit, such as keypad, a set of buttons or a touchscreen.

Using the input unit 18 and the control unit 17, the slider can configure the acceleration when using the acceleration section 1. The slider can for example input the end speed at the end of the acceleration. The slider could also input or select an acceleration profile which determines the amount of acceleration over time during the acceleration process. The control unit preferably limits the end speed and/or the maximum acceleration to predetermined maximum values.

The slider might choose one out of a set of predetermined acceleration profiles, such as a constant acceleration, a constantly increasing acceleration or a variable acceleration, such as an acceleration profile having multiple local maxima and/or minima. The slider could also select a random acceleration profile. Still further, the slider could draw his own acceleration profile as a graph.

The input unit 18 can be provided inside the raft 5 such that the slider can input data while being in the raft, for example while waiting for the acceleration process.

In another embodiment, the control unit 17 might also control lighting equipment and/or sound equipment which creates a light show or plays sound, respectively, during the acceleration process or the whole sliding experience. The slider might also select a lighting scheme and/or a sound scheme using the input unit 18.

In the embodiment shown in FIG. 1, the acceleration section 1 accelerates the rafts 5 into two tube-like water slides. Those two water slides might be identical, mirrored or designed individually. In addition, the water slides might have different profiles, like a closed tube or an open raft.

The subsequent sliding trail 10 might end in a landing area, but also in a sliding trail 2 of an acceleration section 1. In one embodiment, the subsequent sliding trail 10 ends in the same sliding trail 2 in which the raft was accelerated into the subsequent sliding trail 10. However, the subsequent sliding trail 10 could end in another sliding trail 2, such that the raft can slide on multiple subsequent sliding trails 10 without the slider having to leave the raft 5. This results in a moebius-like water slide which can have any number of acceleration sections.

In the embodiments shown in FIGS. 1 to 7, the acceleration section 1 can accelerate the raft or slider in one direction only. This requires the accelerator car 6 to return to the start position of the acceleration before the next raft or slider can be accelerated. However, subsequent sliding trails 10 can be provided at both ends of each sliding trail 2 and the acceleration section 1 can accelerate one raft or slider into one subsequent sliding trail 10 and another raft or slider into another subsequent sliding trail 10 in the opposite direction. This er increases the capacity of the acceleration section 1 and can also provide different slide experiences depending on the characteristics of subsequent sliding trails 10.

The invention claimed is:

1. An acceleration section for a water slide, comprising:
a sliding trail in which a person can slide,
a pusher inside the sliding trail, the pusher being configured to accelerate the person inside the sliding trail,
an accelerator track outside of the sliding trail,
an accelerator car running on the accelerator track and configured to be accelerated along the accelerator track, and
a coupling unit mechanically coupling the pusher and the accelerator car.

2. The acceleration section of claim 1, wherein the accelerator track is parallel to the sliding trail.

3. The acceleration section of claim 2, further comprising a drive system configured to accelerate the accelerator car along the accelerator track.

4. The acceleration section of claim 1, further comprising a drive system configured to accelerate the accelerator car along the accelerator track.

5. The acceleration section of claim 4, wherein the drive system is configured to accelerate the accelerator car in two opposing directions.

6. The acceleration section of claim 5, further comprising a control unit for controlling the drive system and an input unit for inputting commands to the control unit, wherein the control unit is configured to control the acceleration caused by the drive system according to user input of the person to be accelerated.

7. The acceleration section of claim 4, further comprising a control unit for controlling the drive system and an input unit for inputting commands to the control unit, wherein the control unit is configured to control the acceleration caused by the drive system according to user input of the person to be accelerated.

8. The acceleration section of claim 1, wherein the pusher includes a tongue supporting the person and being guided on the sliding trail.

9. The acceleration section of claim 1, wherein the pusher further comprises a passenger cabin limiting freedom of movement of the person during the acceleration.

10. The acceleration section of claim 1, wherein the sliding trail has a U-shaped cross section.

11. The acceleration section of claim 1, further comprising a feeding section configured to move the person into the sliding trail.

12. The acceleration section of claim 11, wherein the feeding section comprises a carriage configured to laterally move the person into the sliding trail.

13. The acceleration section of claim 1, further comprising at least one additional sliding trail parallel to the sliding trail, an additional pusher in each additional sliding trail, and an additional coupling unit for each additional pusher, wherein each additional coupling unit mechanically couples the additional pusher to the accelerator.

14. The acceleration section of claim 1, wherein the pusher comprises at least one shoulder contact member for contacting a shoulder of the person in the sliding trail.

15. The acceleration section of claim 1, wherein the person resides in a raft and the pusher has a surface which forms a form fit with at least a part of the raft or the pusher has a surface for contacting the raft, the surface being inclined towards a bottom of the sliding trail.

16. The acceleration section of claim 1, further comprising a raising mechanism for raising the pusher out of the sliding trail.

17. A water slide, comprising:
an acceleration section, the acceleration section comprising:
a sliding trail in which a person can slide;
a pusher inside the sliding trail, the pusher being configured to accelerate the person inside the sliding trail;
an accelerator track outside of the sliding trail;
an accelerator car running on the accelerator track and configured to be accelerated along the accelerator track; and
a coupling unit mechanically coupling the pusher and the accelerator car.

18. The water slide of claim 17, further comprising a drive system configured to accelerate the accelerator car along the accelerator track.

19. A method, comprising:
providing an acceleration section, the acceleration section comprising:
a sliding trail in which a person can slide;
a pusher inside the sliding trail, the pusher being configured to accelerate the person inside the sliding trail;
an accelerator track outside of the sliding trail;
an accelerator car running on the accelerator track and configured to be accelerated along the accelerator track; and
a coupling unit mechanically coupling the pusher and the accelerator car.

20. The method of claim 19, further comprising providing a water slide comprising the acceleration section.

* * * * *